US009541265B2

(12) United States Patent
Bobbo et al.

(10) Patent No.: US 9,541,265 B2
(45) Date of Patent: Jan. 10, 2017

(54) MOUNTING DEVICE FOR LIGHTING SOURCES AND ASSOCIATED METHOD

(71) Applicant: OSRAM GmbH, Munich (DE)

(72) Inventors: Simon Bobbo, Chirignago (IT); Alberto Zanotto, Padua (IT); Franco Zanon, Cassola (IT)

(73) Assignee: OSRAM GMBH, Munich (DE)

( * ) Notice: Subject to any disclaimer, the term of this patent is extended or adjusted under 35 U.S.C. 154(b) by 162 days.

(21) Appl. No.: 14/402,108

(22) PCT Filed: May 17, 2013

(86) PCT No.: PCT/EP2013/060307
§ 371 (c)(1),
(2) Date: Nov. 19, 2014

(87) PCT Pub. No.: WO2013/174766
PCT Pub. Date: Nov. 28, 2013

(65) Prior Publication Data

US 2015/0124463 A1 May 7, 2015

(30) Foreign Application Priority Data

May 21, 2012 (IT) ..... TO2012A0443

(51) Int. Cl.
*F21V 19/00* (2006.01)
*F21V 17/16* (2006.01)
(Continued)

(52) U.S. Cl.
CPC ..... *F21V 19/004* (2013.01); *F21V 17/12* (2013.01); *F21V 17/162* (2013.01);
(Continued)

(58) Field of Classification Search
CPC .. F21V 19/005; F21V 19/0035; F21V 19/004; F21V 19/002; F21V 17/12; F21V 19/0055; F21V 17/164
See application file for complete search history.

(56) References Cited

U.S. PATENT DOCUMENTS 6,786,691 B2 * 9/2004 Alden, III ..... F16B 35/041 411/352
7,906,731 B2 3/2011 Matsui et al.
(Continued)

FOREIGN PATENT DOCUMENTS

DE WO 2012163625 A1 * 12/2012 ..... F21K 9/17
EP 2413021 A2 2/2012
(Continued)

OTHER PUBLICATIONS

International Search Report of PCT/EP2013/060307 dated Aug. 26, 2013.

*Primary Examiner* — Eret McNichols
(74) *Attorney, Agent, or Firm* — Viering, Jentschura & Partner mbB

(57) ABSTRACT

A mounting device for mounting on a substrate a plate or board-like lighting source may include a frame member for surrounding the plate or board-like lighting source, anchoring formations for anchoring the frame member onto the substrate while permitting movement of the frame member towards and away from the substrate, elastic means for elastically urging the frame member towards the substrate, and one or more locking members mounted on the frame member and radially displaceable with respect to the frame member between: a radially outward position, in which the plate or board-like lighting source can be inserted into the frame member and positioned between the frame member and the substrate, and a radially inward position, in which the locking member(s) abuts/abut against the plate or board-like lighting source located between the frame member and
(Continued)

the substrate, elastically urging the plate or board-like lighting source towards the substrate.

18 Claims, 3 Drawing Sheets

(51) Int. Cl.
*F21V 17/12* (2006.01)
*F21Y 101/00* (2016.01)

(52) U.S. Cl.
CPC ..... *F21V 17/164* (2013.01); *F21V 19/001* (2013.01); *F21V 19/002* (2013.01); *F21V 19/0035* (2013.01); *F21V 19/0055* (2013.01); *F21Y 2101/00* (2013.01); *Y10T 29/4913* (2015.01)

(56) References Cited

U.S. PATENT DOCUMENTS 7,988,336 B1 * 8/2011 Harbers ..... F21K 9/00 257/712
8,240,887 B2 * 8/2012 Daily ..... F21V 5/007 362/236
8,241,044 B2 * 8/2012 Mostoller ..... F21K 9/00 362/249.02
8,405,288 B2 * 3/2013 Tsai ..... F21V 19/0055 313/46
8,727,568 B2 5/2014 Oyaizu et al.
8,845,146 B2 9/2014 Blankestijn et al.
8,926,134 B2 * 1/2015 Hast ..... F21V 17/162 362/227
8,926,146 B2 * 1/2015 Alfier ..... F21V 19/0035 362/382
9,093,004 B2 * 7/2015 Pearson ..... E04H 3/30
9,157,612 B2 * 10/2015 Alfier ..... F21V 29/004
9,255,698 B2 * 2/2016 Scordino ..... F21V 19/005
9,303,851 B2 * 4/2016 Tachino ..... F21K 9/00
2006/0141851 A1 * 6/2006 Matsui ..... F21K 9/00 439/490
2008/0050196 A1 * 2/2008 Cao ..... F16B 5/0266 411/107
2008/0224166 A1 * 9/2008 Glovatsky ..... F21S 48/115 257/99
2011/0063849 A1 * 3/2011 Alexander ..... F21S 48/328 362/294
2011/0136394 A1 * 6/2011 Mostoller ..... F21K 9/00 439/701
2011/0176308 A1 * 7/2011 Wu ..... F21S 4/28 362/247
2012/0051065 A1 * 3/2012 Daily ..... F21V 5/007 362/311.02
2012/0156920 A1 * 6/2012 Sakai ..... H01R 4/4818 439/387
2013/0077324 A1 * 3/2013 Schroll ..... F21V 19/002 362/382
2013/0121759 A1 * 5/2013 Breidenassel ..... F21V 7/00 403/330
2014/0268834 A1 * 9/2014 Zanotto ..... F21V 19/0035 362/382
2014/0268886 A1 * 9/2014 Schroll ..... F21K 9/30 362/652
2014/0268887 A1 * 9/2014 Schroll ..... F21K 9/30 362/652
2015/0055356 A1 * 2/2015 Derks ..... H01R 13/24 362/418
2015/0070918 A1 * 3/2015 Stucchi ..... F21K 9/00 362/457
2015/0117033 A1 * 4/2015 Chiu ..... F21V 19/0055 362/363
2016/0076745 A1 * 3/2016 Hirano ..... F21V 19/0015 362/382
2016/0102848 A1 * 4/2016 Stucchi ..... F21V 19/002 362/373

FOREIGN PATENT DOCUMENTS

IT EP 2581655 A2 * 4/2013 ..... F21K 19/0035
IT WO 2013182223 A1 * 12/2013 ..... F21V 19/0055
JP WO 2010007835 A1 * 1/2010 ..... F21V 15/013
JP WO 2014192280 A1 * 12/2014 ..... F21V 29/20
JP EP 2570721 B1 * 4/2015 ..... F21V 29/22
NL WO 2015101420 A1 * 7/2015 ..... F21V 19/0055
TW DE 202013103533 U1 * 8/2013 ..... F21K 9/1355
WO 2006049086 A1 5/2006
WO 2010146509 A1 12/2010

* cited by examiner

MOUNTING DEVICE FOR LIGHTING SOURCES AND ASSOCIATED METHOD

RELATED APPLICATIONS

The present application is a national stage entry according to 35 U.S.C. §371 of PCT application No.: PCT/EP2013/060307 filed on May 17, 2013, which claims priority from Italian application No.: TO2012A000443 filed on May 21, 2012, and is incorporated herein by reference in its entirety.

TECHNICAL FIELD

Various embodiments generally relate to mounting devices for lighting sources.

Various embodiments may relate to solid-state lighting sources, for example of the type using LED sources as light radiation sources.

BACKGROUND

In order to mount lighting sources on a substrate such as a PCB (Printed Circuit Board) it is possible to use a fixing system with a screwing action. This solution, however, may result in a non-uniform pressure distribution, so that the thermal interface properties and the heat transfer are not distributed uniformly over the contact surface and may worsen with time.

In order to perform a mechanical and/or thermal connection it has also been proposed using more than a single component or complex structures.

SUMMARY

There therefore exists the need to have simple mounting devices suitable for allowing mounting, in a lighting device (or "luminaire"), of a lighting source (or "light engine") able to provide one or more of the following advantages:

- optimized mechanical contact between the lighting source and the surface of the lighting device/heat sink;
- simple and rapid mounting of the lighting source on the lighting device;
- replacement of the module of the lighting source which is simpler since, for example, in order to disconnect the lighting source (for example of the LED type) from an electrical and mechanical point of view, it is not required to loosen screws;
- a standardized, stable and reliable mounting structure;
- the possibility of providing in a simple manner arrays of several lighting sources;
- an efficient optical output ensured by means of a low-profile support device; and/or
- simplified mounting, for example since no particular tool is required.

Various embodiments provide a response to this need.

Various embodiments may also relate to a corresponding method.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

Figure 1:
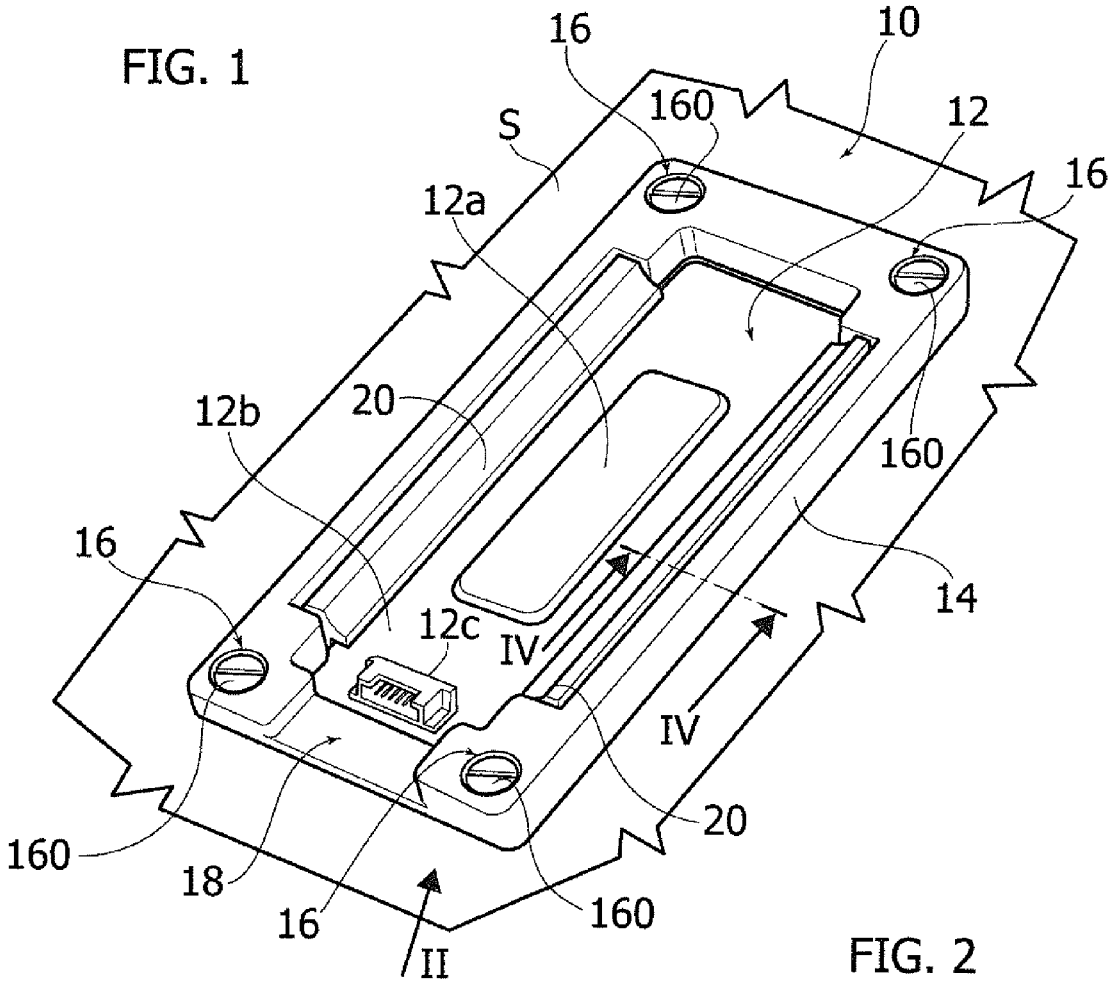
FIG. 1 is a general perspective view of an embodiment.

The following detailed description refers to the accompanying drawing that show, by way of illustration, specific details and embodiments in which the disclosure may be practiced.

In the following description various specific details aimed at providing a fuller understanding of various embodiments are explained. The embodiments may be implemented without one or more of the specific details, using other methods, components, materials, etc. In other cases, known structures, materials or operations are not shown or described in detail so that various aspects of the embodiments may be understood more clearly.

The reference to "an embodiment" in the context of this description indicates that a particular configuration, structure or characteristic feature described in relation to the embodiment is included in at least one embodiment. Therefore, phrases such as "in an embodiment", which may occur at various points in this description, do not necessarily refer to the same embodiment. Moreover, particular forms, structures or characteristic features may be combined in any suitable manner in one or more embodiments.

The reference numbers used here are provided solely for the sake of convenience and therefore do not define the scope of protection or the range of application of the embodiments.

In the figures, the reference number 10 denotes overall a device which allows a lighting source 12 in the form of a plate or board to be mounted on a substrate S (such as the surface of a heat sink or any other substrate suitable for this purpose).

In various embodiments this may consist of a solid-state lighting source such as a lighting source using an LED source as a light radiation source.

In various embodiments, the light radiation source, denoted by 12*a*, is mounted on a plate 12*b*. Lighting sources of this type are known in the art, and so here a more detailed description is not required.

In various embodiments, as shown by way of example in the figures, both the light radiation source 12*a* and the plate 12*b*, and therefore the lighting source 12 as a whole, have an overall rectangular shape.

The reference to this shape is intended solely by way of example and must therefore not be interpreted as limiting the embodiments.

Substantially similar considerations are also applicable to a frame member 14 which can be used to mount the lighting source 12 on the substrate S. In various embodiments, the frame member 14 may be configured so as to surround, precisely in the manner of a frame, the lighting source 12 mounted on the substrate S, allowing the light radiation generated by the radiation source 12*a* to propagate freely from the substrate S. Consequently, in various embodiments, the frame member 14 may have a form matching the contour of the lighting source 12.

In the examples of embodiments considered here, where the lighting source 12 has an overall rectangular shape, the frame member 14 also has a rectangular shape. In the case where the light source 12 has, for example, a square, polygonal, circular, elliptical or mixtilinear shape, the frame member 14 may also correspondingly have a square, polygonal, circular, elliptical or mixtilinear shape. It will also be understood that, while the examples of embodiments considered here refer to a frame member 14 with an overall closed shape (and therefore with an overall closed-ring structure), various embodiments may envisage the use of a frame member with an open shape, for example a U shape or a C shape (referring for example to a rectangular shaped lighting source 12).

The reference number 16 denotes anchoring formations which are able to anchor the frame member 14 onto the substrate S, while allowing the frame member 14 itself to move towards or away from the substrate S, so as to be "floating" as it were with respect to the substrate S.

For example, in various embodiments, the anchoring formations 16 may include a screw 160 which extends inside a corresponding hole 162 (see in particular FIGS. 3 and 7) provided in the frame member 14. A coil spring 164 fitted on the stem or shank of the screw 160 may thus be able to act between the head 160*a* of the screw 160 and the wall of the hole 162 (for example cooperating in abutment with an end shoulder 162*a* of the hole, visible clearly only in FIG. 3) so as to urge the frame member 14 towards the substrate S.

Figure 5:
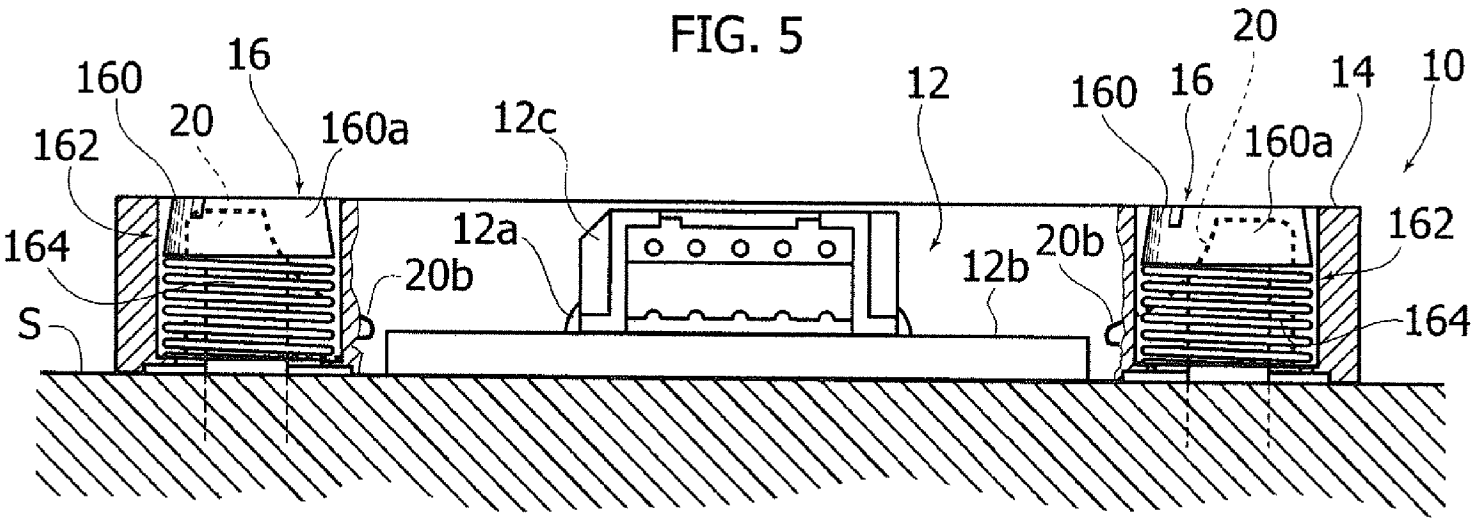
FIGS. 5 and 6 illustrate modes of use of embodiments.
Figure 6:
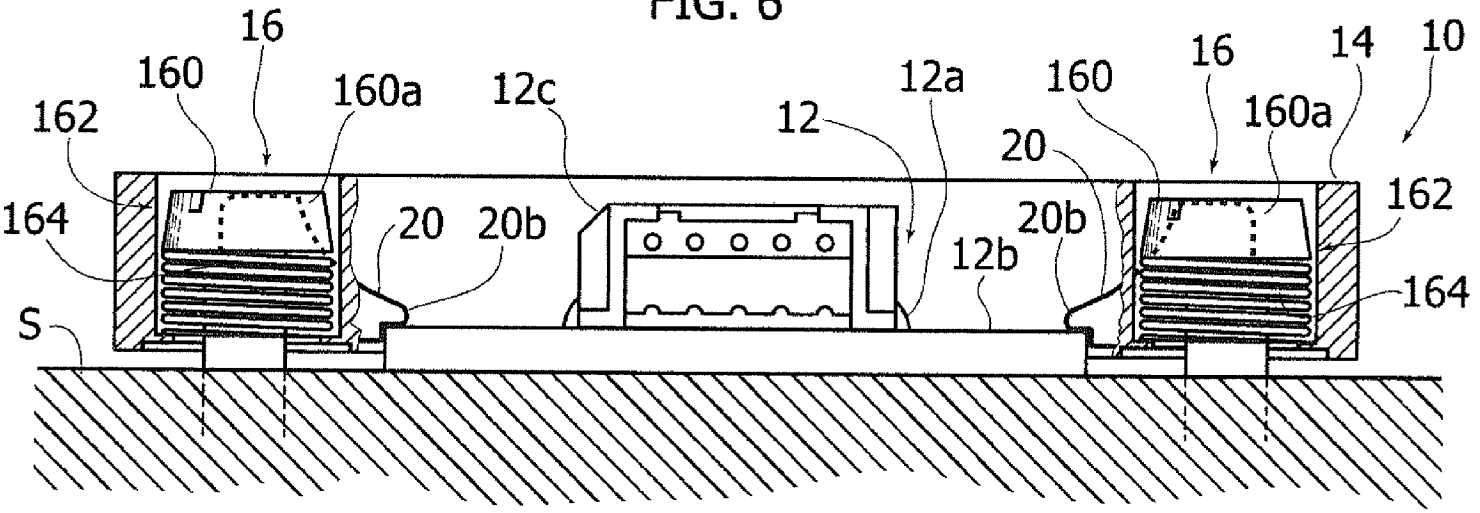

Viewing FIGS. 5 and 6 it can be seen that the length of the screw or screws 160 is chosen so that, although being anchored onto the substrate S, the frame member 14 is "floating" with respect to the substrate S with the possibility of moving towards and away from the substrate S, being at the same time urged towards the substrate S with a force determined by the spring 164 (as well as, if appropriate, by the screwing position of the screws 16).

The examples of embodiments to which the accompanying figures refer envisage the presence of four anchoring formations 16. In the example considered here, in which the frame member 14 has a rectangular shape, the anchoring formations 16 may be located at the vertices of the rectangular shape.

The anchoring formation or formations 16 (which may be present in any number) may be formed and/or located in different positions. This is applicable, for example, in the case where the frame member 14 has a shape different from the rectangular shape shown here. For example, in the case where a frame member 14 has a circular shape, several anchoring formations 16 may be distributed along the circular contour of this frame member.

Figure 2:
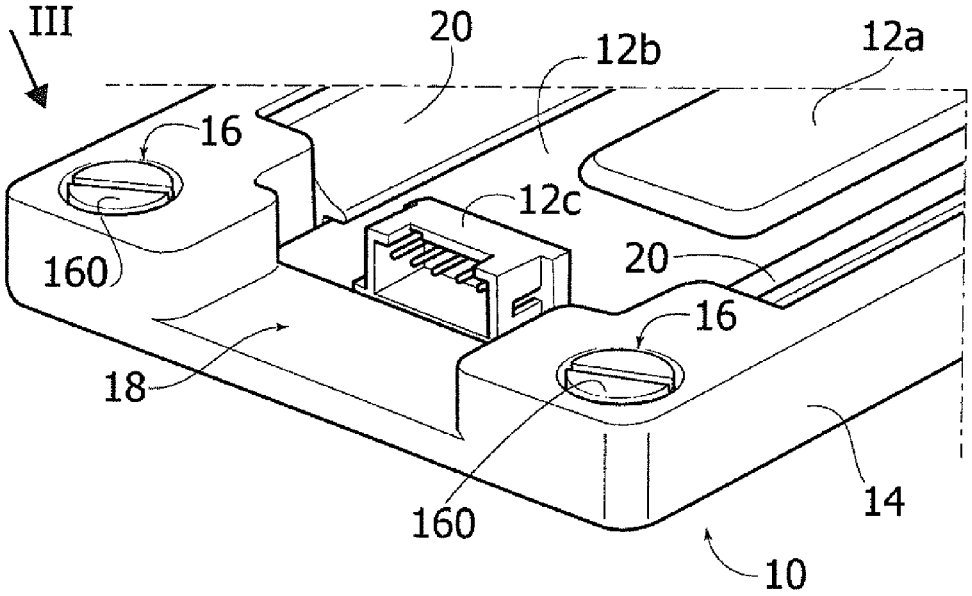
FIGS. 2 and 3 are partial views, reproduced on a large scale, of parts of FIG. 1, in the direction of the arrow II shown in FIG. 1 and the arrow III shown in FIG. 2, respectively.
Figure 3:
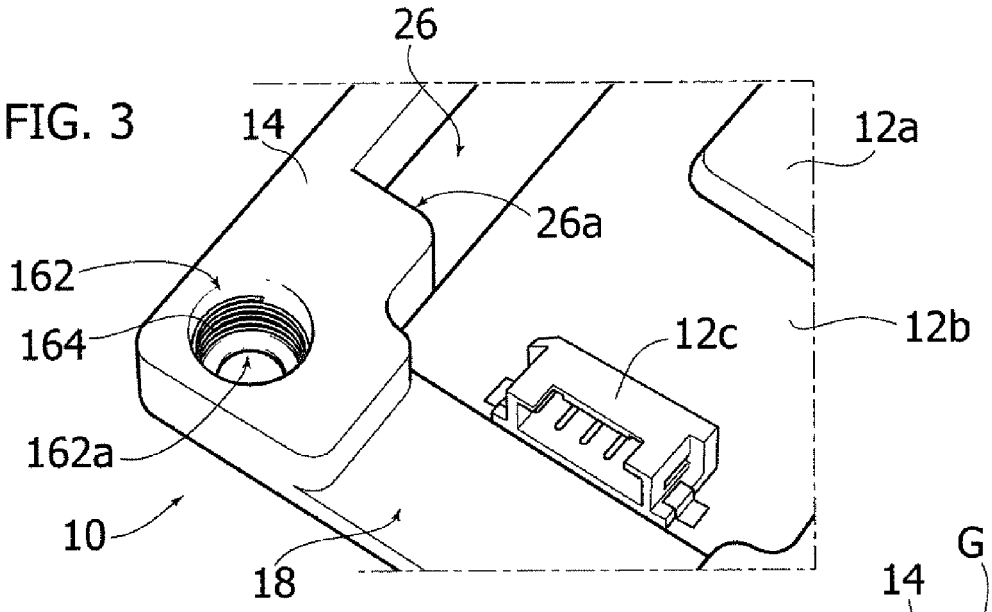

The views shown in FIGS. 2 and 3 illustrate the possible presence, in the frame of the member 14, of a notch formation 18 which allows access (for example by means of an electrical connection cable) to a connector 12*c* provided on the plate 12*b* so as to allow the transmission of electrical signals (for example electric power supply signals and, where appropriate, command and/or feedback signals) from and to the light radiation source 12*a*.

In the figures, the reference number 20 denotes a pair of locking members mounted on the frame member 14 with the capacity of moving radially with respect to the frame member 14 between:

- a radially outward (or widened or expanded) position shown in FIG. 5; and
- a radially inward (or clamped or contracted) position shown in FIG. 6.

In various embodiments, the locking member or members 20 (which may consist of any number) may be in the form of bars mounted along the contour of the frame member 14.

The figures show an example of an embodiment in which two locking members 20 are present, both in the form of bars, mounted along the greater sides of the general rectangular shape of the frame member 14.

As already mentioned on several occasions above, in various embodiments, the frame member 14 may have varying shapes. In various embodiments, the form and/or the number of the locking members 20 may therefore be correspondingly modified.

For example, as regards the form, in the case of a frame member 14 with a circular shape, the locking members 20 may have, instead of a rectilinear shape, a curved shape and thus form, for example, a pair of jaws, as it were, designed to cooperate with the contour of the lighting source 12 in the manner which will be illustrated more fully below.

As regards the number, the figures refer to examples of embodiments where two complementary locking members 20 are present, both being radially movable with respect to the frame member 14 towards and away therefrom. In various embodiments, it is possible to envisage the presence also of only one locking member with this capacity for movement. For example, again with reference to the possible examples of embodiments envisaged in the figures, one of the members 20 considered there could be formed as a fixed part of the frame member 14, with only the opposite locking member 20 retaining the aforementioned capacity for movement between a radially outward position and a radially inward position.

Figure 7:
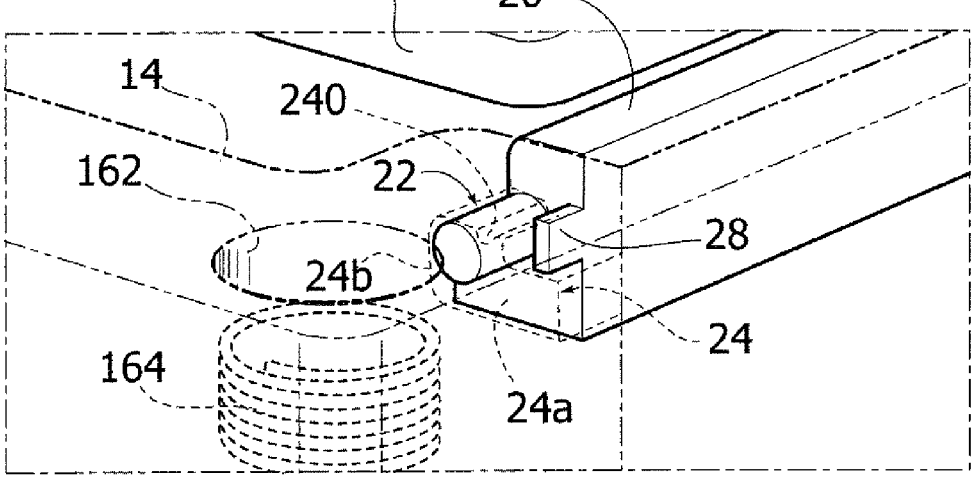
FIG. 7 is a view, reproduced on a still larger scale, of details of embodiments.

In various embodiments, coupling between the or each locking member 20 and the frame member 14 may be performed in the manner schematically illustrated in FIG. 7.

This figure shows an example of a pin-and-groove coupling in which, at one or both the ends of the locking member 20, there is a projecting pin 22 able to engage slidably inside a groove 24 formed in the body of the frame member 14.

In various embodiments the locking member or each of the locking members 20 may be mounted in a seat 26 provided on the inner side of the frame member 14 and extending between two end walls 26*a* (see in particular FIG. 3) which are able to house the groove 24.

In the examples of embodiment shown, the groove 24 includes a first portion 24*a* and a second portion 24*b*.

The first portion 24*a* of the groove 24 extends radially with respect to the frame member 14 and the pin 22 mounted on the or on each locking member 20 is able to slide inside the first portion 24*a* of the groove 24 when the respective locking member moves radially with respect to the frame member 14 between the radially outward position and the radially inward position to which reference has already been made above.

From the end of the first portion 24*a* of the groove 24 facing the inside of the frame member 14 there extends (orthogonally relative to the first portion 24*a*) a second groove portion 24*b* inside which the pin 22 mounted on the or on each locking member 20 is able to move following the movement which the frame member 14 is able to perform towards and away from the substrate S as a result of the elastic anchoring action exerted by the anchoring formations 16 described above.

In various embodiments, the groove 24 therefore has a general L-shaped configuration, preferably with the distal arm of the L directed away from the substrate S.

In various embodiments, between the frame member 14 and the or each locking member 20 there may be provided a further tongue 28 acting as an end stop so as to define the (radially outward) fully retracted position of the member 20 inside the seat 26 provided in the frame member 14.

In various embodiments, within the groove 20, more specifically at the end of the second portion 24*b*, it is possible to envisage a formation such as an extrusion 240 constituting a stop formation for the pin 22 able to keep the member 20 in the (radially inward) fully advanced position inside the frame member 14.

In various embodiments, the pin-and-groove coupling arrangement described with reference to FIG. 7 may be duplicated symmetrically at both the ends of the or each locking member 20.

The examples of embodiment shown here envisage that the pin member 22 is provided on the locking member 20 and that the groove 24 is provided in the frame member 14. In various embodiments the constructional design of the or each coupling may be exactly complementary, and therefore with a pin provided on the frame member 14 and a groove provided on the or on each locking member 20.

Figure 4:
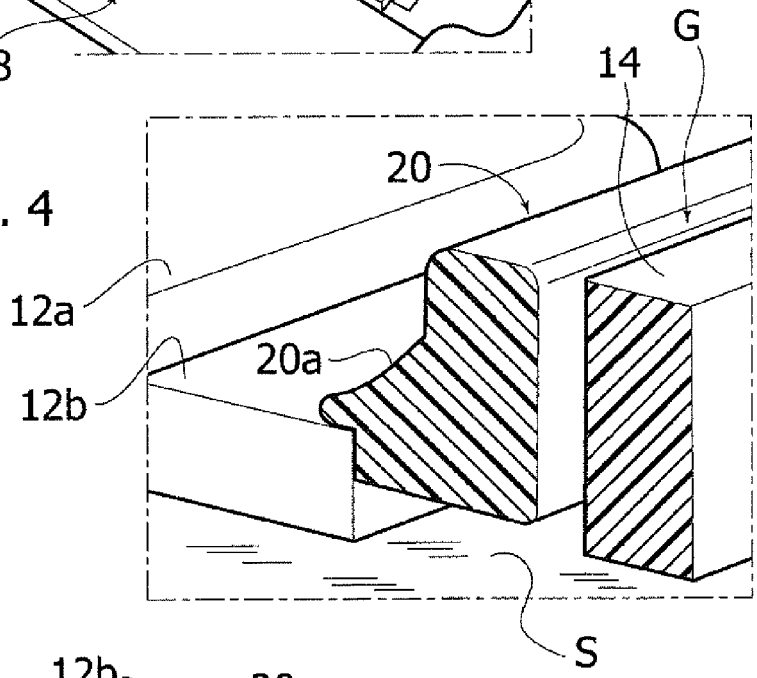
FIG. 4 is a cross-sectional view approximately along the line IV-IV of FIG. 1.

As can be understood more clearly from the view shown in FIG. 4, the or each locking member 20 has, on the side directed towards the outside of the frame member 14, a sloping surface 20*a* diverging towards the outside of the frame member, and therefore away from the substrate S, for example with one or more sections having a different inclination.

As schematically shown in FIG. 5, when they are in the radially outward condition, the locking members 20 (below reference will be made by way of example to an embodiment in which there are two of these members situated in diametrically opposite positions with respect to the frame member 14) allow the lighting source 12 to be introduced into the frame member 14 until it is in fact situated between the substrate S and the frame member 14.

The presence of the sloping surfaces 20*a* facilitates insertion of the lighting source 12 inside the frame 12, also ensuring centering of the source 12 with respect to the frame member 14.

The locking members 20 may then be pushed towards each other also by means of a simple manual operation, without having to use any tool, for example making use of the possible presence of a space (denoted by G only in FIG. 4) between each locking member 20 and the side of the frame member 14 along which this locking member 20 extends. In this radially inward position, the locking members 20 engage, for example with their radially inner edges (or "protrusions") 20*b*, with the contour of the lighting source 12 (for example along the two greater sides of the plate 12*b*, when the latter has a rectangular configuration), abutting against this contour.

In these conditions:

- the movement of the lighting source 12 in the direction allowing extraction from the frame member 14 (namely in the direction away from the substrate S) is prevented by the members 20, and
- owing to the action of the springs 164 of the formations 16, the frame member 14 elastically urges the lighting source 12 against the substrate S.

In various embodiments, mechanical coupling of the lighting source 12 with the substrate S (for example a heat sink) may be achieved by means of screws 162, thereby allowing insertion of the plate 12*b* carrying the light radiation source 12*a* (and, where applicable, the associated drive and control circuitry), said plate being inserted inside the frame member 14 with the members 20 splayed in their outward position. The lighting source 12 may then be kept anchored on the substrate S by sliding the locking members 20 in the radial direction towards the inside of the frame member 14 (i.e. from the position shown in FIG. 5 into the position shown in FIG. 6) so as to press the plate 12*b*, and therefore the lighting source 12 as a whole, against the substrate S.

The aforementioned sliding movement of the locking members 20 may be achieved in various embodiments owing to the pin-and-groove coupling system described above with reference to FIG. 7.

The action of the springs 164 associated with the mounting formations 16 allows a uniform pressure of the plate 12*b* against the substrate S to be achieved.

In various embodiments, as a result of this uniform pressure it is possible to ensure a better thermal connection compared to that which may be achieved with a mechanical connection performed exclusively using screws.

The profile of the locking members 20, for example the presence of the protrusions 20*b*, facilitates the sliding movement of the locking members 20 on the edges of the plate 12*b*. In various embodiments, along the recesses 26 where the locking members 20 are mounted, it is possible to provide guide pins (only partly visible in the figures) able to ensure the uniformity of the sliding movement of the locking members 20 with respect to the frame member 14.

In various embodiments, when the locking members 20 are in their closed position, namely in the radially inward position shown in FIG. 6, the elastic force which urges the luminous lighting source 12 against the substrate S may be such that the frame member 14 is raised from the substrate S.

The locking members 20 allow the elastic force which urges the lighting source 12 against the substrate S to be uniformly distributed along the edges of the plate 12*b*.

By means of various embodiments it is therefore possible to achieve one or more of the following advantages:

- interchangeability of the light radiation source 12 achieved by means of the locking members 20, and therefore without the need to slacken screws or other clamping formations when it is required to perform replacement of the lighting source 12;
- possibility of achieving a uniformly distributed pressure on the contact surface between the lighting source 12 and the substrate S (which may consist, for example, of a heat sink) so as to achieve an optimum thermal connection;
- possibility of adjusting (via the elastic force of the springs 164 and/or the screwing position of the screws 16) the pressure which urges the light radiation source 12 against the substrate S depending on the heat exchange requirements;
- possibility of providing a low-cost solution based on the use of a base member consisting of the frame member 14, without having to use further parts for achieving the mechanical and thermal connection of the lighting source 12 onto the substrate S.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A mounting device for mounting on a substrate a plate or board-like lighting source, comprising:

a frame member for surrounding said plate or board-like lighting source, a set of anchoring formations for anchoring said frame member onto said substrate while permitting movement of said frame member towards and away from said substrate, elastic means for elastically urging said frame member towards said substrate, and at least one locking member mounted on said frame member and laterally displaceable with respect to said frame member between:

a laterally outward position, in which said plate or board-like source can be inserted into said frame member and positioned between said frame member and said substrate, and a laterally inward position, in which said at least one locking member abuts against said plate or board-like lighting source located between said frame member and said substrate, elastically urging said plate or board-like lighting source towards said substrate.

2. The device as claimed in claim 1, wherein said frame member comprises two opposite rectilinear sides and wherein said at least one locking member comprises a bar member extending along one of said opposite rectilinear sides.

3. The device as claimed in claim 1, wherein said at least one locking member is coupled to said frame member via a pin-and-groove arrangement comprising a groove and a pin slidably movable along said groove and wherein said groove comprises:

a first portion extending laterally with respect to said frame member, said pin being slidably movable along said first portion when said at least one locking member moves between said laterally outward position and said laterally inward position, and a second portion extending orthogonally from said first portion, with said pin slidably movable along said second portion when said at least one locking member is in said laterally inward position and elastically urges said plate or board-like lighting source towards said substrate.

4. The device as claimed in claim 3, wherein said groove has at least one of the following:

said second portion has an end-of-travel formation for locking said pin in said second portion with said at least one locking member in said laterally inward position, and said first portion is coupled with a tongue for locking said pin in said first portion with said at least one locking member in said laterally outward position.

5. The device as claimed in claim 3, wherein said at least one locking member comprises an elongate body having two opposite ends with one said pin-and-groove arrangement at each said opposite ends.

6. The device as claimed in claim 3, wherein in said pin-and-groove arrangement said at least one locking member is provided with the pin and said frame member is provided with the groove.

7. The device as claimed in claim 1, wherein said at least one locking member has a sloping surface diverging towards an outside of said frame member so as to facilitate insertion of said plate or board-like lighting source therein.

8. The device as claimed in claim 1, wherein said anchoring formations comprise a screw extending in a hole through said frame member with a coil spring fitted onto said screw, said coil spring acting between the head of said screw and said hole so as to provide an elastic force elastically urging said frame member towards said substrate.

9. The device as claimed in claim 1, further comprising a notch formation in said frame member for allowing access to an electrical connector mounted on said plate or board-like lighting source.

10. A method of mounting onto a substrate a plate or board-like lighting source, comprising:

providing a frame member for surrounding said plate or board-like lighting source, anchoring said frame member onto said substrate so as to allow movement thereof towards and away from said substrate, with said frame member elastically urged towards said substrate, providing at least one locking member mounted on said frame member and laterally displaceable with respect to said frame member between a laterally outward position and a laterally inward position, with said at least one locking member in said laterally outward position, after said providing the frame member, inserting said plate or board-like lighting source in said frame member so as to position said source between said frame member and said substrate, and moving said at least one locking member into said laterally inward position, in which said at least one locking member abuts against said plate or board-like lighting source located between said frame member and said substrate and elastically urges said plate or board-like lighting source towards said substrate.

11. A mounting device for mounting on a substrate a plate or board-like lighting source, comprising:

a frame member for surrounding said plate or board-like lighting source, a set of anchoring formations for anchoring said frame member onto said substrate while permitting movement of said frame member towards and away from said substrate, elastic means for elastically urging said frame member towards said substrate, and at least one locking member mounted on said frame member and laterally displaceable with respect to said frame member between:

a laterally outward position, in which said plate or board-like source can be inserted into said frame member and positioned between said frame member and said substrate, and a laterally inward position, in which said at least one locking member abuts against said plate or board-like lighting source located between said frame member and said substrate, elastically urging said plate or board-like lighting source towards said substrate, wherein said frame member comprises two opposite rectilinear sides and wherein said at least one locking member comprises a bar member extending along one of said opposite rectilinear sides.

12. The device as claimed in claim 11, wherein said at least one locking member is coupled to said frame member via a pin-and-groove arrangement comprising a groove and a pin slidably movable along said groove and wherein said groove comprises:

a first portion extending laterally with respect to said frame member, said pin being slidably movable along said first portion when said at least one locking member moves between said laterally outward position and said laterally inward position, and a second portion extending orthogonally from said first portion, with said pin slidably movable along said second portion when said at least one locking member is in said laterally inward position and elastically urges said plate or board-like lighting source towards said substrate.

13. The device as claimed in claim 12, wherein said groove has at least one of the following:

said second portion has an end-of-travel formation for locking said pin in said second portion with said at least one locking member in said laterally inward position, and said first portion is coupled with a tongue for locking said pin in said first portion with said at least one locking member in said laterally outward position.

14. The device as claimed in claim 12, wherein said at least one locking member comprises an elongate body having two opposite ends with one said pin-and-groove arrangement at each said opposite ends.

15. The device as claimed in claim 12, wherein in said pin-and-groove arrangement said at least one locking member is provided with the pin and said frame member is provided with the groove.

16. The device as claimed in claim 11, wherein said at least one locking member has a sloping surface diverging towards an outside of said frame member so as to facilitate insertion of said plate or board-like lighting source therein.

17. The device as claimed in claim 11, wherein said anchoring formations comprise a screw extending in a hole through said frame member with a coil spring fitted onto said screw, said coil spring acting between the head of said screw and said hole so as to provide an elastic force elastically urging said frame member towards said substrate.

18. The device as claimed in claim 11, further comprising a notch formation in said frame member for allowing access to an electrical connector mounted on said plate or board-like lighting source.

* * * * *